United States Patent [19]

Mohaupt

[11] 4,380,265

[45] Apr. 19, 1983

[54] METHOD OF TREATING A HYDROCARBON PRODUCING WELL

[76] Inventor: Henry H. Mohaupt, 1151 Estrella Dr., Santa Barbara, Calif. 93110

[21] Appl. No.: 237,538

[22] Filed: Feb. 23, 1981

[51] Int. Cl.[3] ..... E21B 43/24; E21B 43/26; E21B 47/00

[52] U.S. Cl. ..... 166/250; 166/260; 166/300; 166/303; 166/308

[58] Field of Search ..... 166/290, 256, 260, 279, 166/300, 303, 308

[56] References Cited

U.S. PATENT DOCUMENTS

| | | | |
|---|---|---|---|
| 2,858,408 | 3/1958 | Watson | 166/300 X |
| 2,858,891 | 11/1958 | Moll et al. | 166/300 X |
| 2,939,688 | 6/1960 | Pelzer | 166/300 |
| 2,941,595 | 6/1960 | Emery | 166/300 |
| 3,010,516 | 11/1961 | Schleicher | 166/256 |
| 3,012,607 | 12/1961 | De Priester et al. | 166/300 X |
| 3,026,937 | 3/1962 | Simm | 166/260 |
| 3,035,638 | 5/1962 | Parker et al. . | |
| 3,075,463 | 1/1963 | Eilers et al. . | |
| 3,093,191 | 6/1963 | Glass . | |
| 3,126,956 | 3/1964 | Berry et al. . | |
| 3,141,504 | 7/1964 | Sarapuu . | |
| 3,223,165 | 12/1965 | Hujsak | 166/300 |
| 3,227,215 | 1/1966 | Marx . | |
| 3,298,439 | 1/1967 | Rees | 166/256 X |
| 3,386,512 | 6/1968 | Bloom . | |
| 3,449,247 | 6/1969 | Bauer . | |
| 3,674,093 | 7/1972 | Reese | 166/299 |
| 3,727,690 | 4/1973 | Munson . | |
| 4,049,056 | 9/1977 | Godfrey | 166/299 |

*Primary Examiner*—Stephen J. Novosad
*Assistant Examiner*—George A. Suchfield
*Attorney, Agent, or Firm*—G. Turner Moller

[57] ABSTRACT

A method of treating a hydrocarbon producing well involves injecting into the well a combustible mixture including a gaseous phase material. The combustible mixture is ignited to produce a quantity of hot combustion products which flow into a hydrocarbon bearing formation. Because of the relatively rapid travel of these combustion products, some fracturing of the formation occurs adjacent the well bore which increases permeability of the formation. When the formation contains low gravity, high viscosity oil, the hot combustion products also heat the oil thereby lowering its viscosity and also provides some gas which may become intermingled or dissolved in the oil to provide a drive mechanism for moving the oil into the well bore where it can be recovered by conventional pumping devices.

12 Claims, 2 Drawing Figures

METHOD OF TREATING A HYDROCARBON PRODUCING WELL

Figure 1:
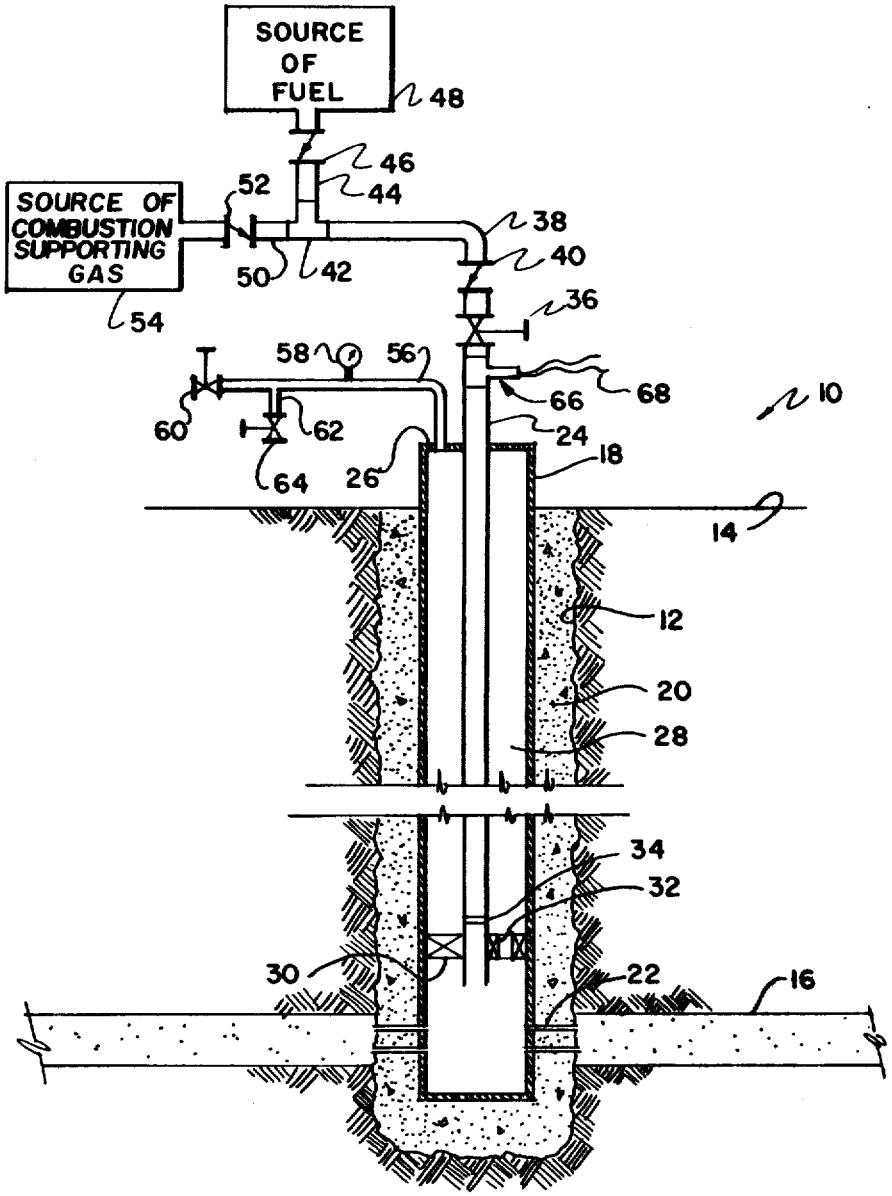

This invention relates to a method for treating a hydrocarbon producing well and more particularly to a technique for periodically burning a combustible mixture in the well to produce hot combustion products that flow into the hydrocarbon bearing formation.

There are a number of well known techniques for thermally stimulating heavy oil producing formations. Probably the most common is a technique wherein steam is generated at the surface and injected through a tubing string into the hydrocarbon bearing formation to heat the oil therein to reduce its viscosity and to provide a drive mechanism for moving oil from the formation into the well bore. Steam injection is typically performed in one of two ways. The most common technique is known as the huff and puff method where steam is injected into a heavy oil producing well for some period of time, the well is shut in for a number of days and then the well is put on production. There have been suggestions to conduct a steam injection technique on basically a five spot approach where stem is continuously injected into one or more injection wells and oil is continuously produced from one or more production wells.

Another known technique for thermally stimulating heavy oil formations involves the placing of an electrical electrode in the well and delivering electrical current from the electrode which passes through the connate water in the formation. The formation basically acts as an electrical resistor and resistance type heating occurs therein.

Another technique which bears some superficial resemblance to this invention is known in the art as a Talleyfrac. In this technique, a liquified explosive material is injected either through tubing or through casing into the hydrocarbon bearing formation. The explosive material is then detonated to produce a typical explosive type shock wave in the formation which acts to fracture the formation and improve its permeability. It is evident, of course, that the Talleyfrac approach is basically a permeability improving technique and does not involve heating or improving viscosity of hydrocarbons in the formation.

U.S. Pat. No. 2,858,891 is of some interest for the disclosure of filling an annulus between casing and tubing strings of a hydrocarbon producing well with an inert gas by introducing the gas through the tubing, filling the annulus and exhausting the inert gas through a surface connection in the annulus. Thereafter, a fuel is injected through the tubing and a combustion supporting gas is injected through the annulus to produce a combustible mixture at the bottom of the well which is ignited to produce continuous combustion in the bottom of the bore hole.

Also of interest is U.S. Pat. No. 3,674,093 which discloses periodically injecting a combustible liquid into a well and periodically igniting the same in a combustion chamber adjacent the bottom of the well to produce a multiplicity of pressure pulses in the bore hole.

Of some interest is U.S. Pat. No. 4,049,056 which discloses a hydraulic fracing technique in which a combustible mixture is burned inside a pipe string to impart pressure to the frac liquid for fracturing the reservoir and placing the frac liquid therein.

Of more general interest are the disclosure of exemplary combustion techniques in U.S. Pat. Nos. 3,305,638 and 3,375,463.

In summary, one aspect of this invention involves a method for treating a hydrocarbon producing formation of the type penetrated by a well having a string of pipe extending from the surface to adjacent the formation. A combustible mixture including a gaseous phase material is injected into the pipe string at the surface in a quantity sufficient to provide a substantial quantity of the combustible mixture inside of the casing.

The surface equipment of the well includes suitable flow control valves or other equipment to temporarily prevent flow of any combustion products out of the well. This equipment is arranged, during and after injection of the combustible mixture, to prevent such return flow. The combustible mixture is then ignited in any suitable fashion to generate a quantity of hot combustion products. Because of the combustion process, the pressure in the well increases significantly whereby the hot combustion products flow into the formation.

This process or technique is typically repeated a number of times wherein a fairly short time duration, usually one or two days. The periodic injection of hot combustion products into the hydrocarbon bearing formation causes fracturing of a formation adjacent the bore hole, acts to heat any high gravity oil in the formation thereby reducing its viscosity and improving its flow characteristics, and provides a source of gas which becomes intermingled or dissolved with any oil in the formation to provide a drive mechanism for moving oil back into the well bore upon the completion of the treatment.

It is accordingly an object of this invention to provide a technique for improviding the productivity of hydrocarbon bearing formations.

Other objects and advantages of the invention will become more fully apparent as this description proceeds, reference being made to the accompanying drawings and appended claims.

IN THE CLAIMS

Figure 2:
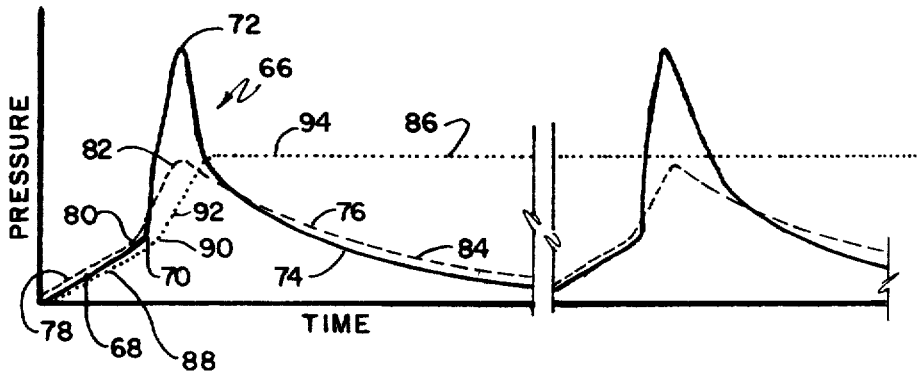

FIG. 1 is a vertical cross-section of a typical hydrocarbon producing well provided with the necessary equipment to perform the method of this invention; and FIG. 2 is a graph illustrating pressure-time relationship of this invention and the prior art.

Referring to FIG. 1, there is illustrated a hydrocarbon producing well 10 comprising a bore hole 12 extending into the earth from the surface 14 to adjacent a hydrocarbon bearing formation 16. A string of casing 18 extends downwardly into the earth to adjacent the formation 16 and typically extends somewhat below the formation 16. The casing string 18 is bonded to the wall of the bore hole 12 by a cement sheath 20. Suitable perforations 22 communicate between the interior of the casing string 18 and the formation 16 to allow entry of formation fluids into the casing string 18 from the formation 16.

A string of tubing 24 extends downwardly inside the casing string 18 to a location adjacent the formation 16. Typically, the tubing string 24 terminates somewhat above the perforations 22. A suitable sealing arrangement, known as a well head 26, supports the upper end of the tubing string 24 and provides a seal between the casing and tubing strings 18, 24. For purposes more fully explained hereinafter, the interior of the tubing string 24 communicates with what is known as the annulus 28, which is the space between the interior of the casing string 18 and the exterior of the tubing string 24. To this end, the tubing string may hang freely inside the casing string 18 or an anchor or hold down 30 may be provided to secure the lower end of the tubing string 24 at a predetermined location inside the casing string 18. The anchor 30 provides one or more passages 32 allowing vertical fluid communication between the lower part of the casing string 18 and the annulus 28.

As heretofore described, the hydrocarbon producing well 10 will be recognized by those skilled in the art as a typical installation. If the formation 16 contains a low gravity, high viscosity oil, the well 10 will be further equipped to accommodate a pumping unit in order to pump oil from the bottom of the casing string 18. To this end, the tubing string 24 is provided with a seating nipple 34 in which a downhole pump (not shown) is landed during pumping. During production of the well 10, there is provided conventional surface equipment such as a pumping tee (not shown), a pump jack (not shown) as well as a downhole pump (not shown) and rod string (not shown) connecting the downhole pump to the pump jack. In preparation for treating the well 10 in accordance with this invention, the downhole pump and rods are pulled from the tubing string 24, as by the use of a conventional workover rig or pulling unit. In addition, the conventional pumping tee screwed to the top of the tubing string 24 is removed.

In preparation for treating the well 10 in accordance with this invention, certain above ground equipment is needed. To this end, the well 10 is equipped with a valve 36 on the upper end of the tubing string 24, a flow line 38 having a check valve 40 therein connected to a tee 42 having a flow line 44 including a check valve 46 leading to a source 48 of combustible fuel and a flow line 50 having a check valve 52 therein leading to a source 54 of combustion supporting gas. Although the fuel provided by the source 48 may be of any suitable type, for example hydrogen, carbide, liquified petroleum gases, or liquid or solid fuels which are atomized or pulverized, the fuel is desirably methane or natural gas available from a gas producing well in the vicinity of the well 10. If the pressure of the available gas is sufficiently high, as more fully explained hereinafter, there is no requirement for a gas compressor. On the other hand, if the gas available is at a pressure insufficient to meet the requirements of this technique, the source 48 may comprise suitable gas compressors to deliver the fuel gas at a pressure sufficient to operate the combustion process.

Although the combustion supporting gas may be commercial grade oxygen from a tank truck carrying liquid oxygen, it is perferred that the source 54 comprise an air compressor to deliver compressed air at a pressure sufficient to operate the combustion process of this invention. It will be apparent that the sources 48, 54 include suitable controls or regulators to control the quantity of fuel from the source 48 and/or air from the source 54 to provide appropriate ratios of fuel and air to produce a combustible mixture. It is evident that the exact ratio of fuel to air is subject to wide variation, since it is not critical whether the mixture be "lean" or "rich" so long as a combustible mixture is produced.

In addition to the gas sources 48, 54 and the ancillary equipment associated therewith, the well 10 is equipped with a vent line 56 communicating with the annulus 28 through the well head 26 and provided with a pressure gauge 58 and a valve 60 for venting gaseous material in the annulus 28 while charging the well 10 with a combustible mixture from the sources 48, 54. In addition, the vent line 56 provides a sampling nipple 62 through the vent line 56 to determine if the combustible mixture has reached the sampling nipple 62 and accordingly has filled the casing 18.

Although the combustible mixture is disclosed in the drawing as being injected down the tubing 24 with the annulus 28 being sampled to detect the presence thereof at the top of the hole, it will be evident that the combustion mixture may be injected into the annulus 28 with the tubing string 24 being sampled at the surface to detect the presence thereof.

As will be appreciated momentarily, a technique is required for initiating combustion of the mixture placed in the well 10. Although combustion may be initiated inside the tubing string 24, as by the provision of a lubricator affixed to the top of the tubing string 24 and wireline arrangement for lowering an ignitor into the tubing string 24, it is preferred for ease of operation that combustion be initiated at the surface. To this end, the flow line 38 or upper end of the tubing string 24 is equipped with an ignitor section 66, located downstream of the valve 36, of any suitable type which delivers a high voltage electric arc inside the flow line 38 in response to the delivery of electrical energy through suitable wires 68.

After the necessary surface equipment has been assembled, the valve 36 is opened and suitable quantities of combustible gas from the source 48 and combustion supporting gas from the source 54 are delivered through the flow lines 44, 50 and through the flow line 38 into the tubing string 24. The bleed off valve 60 is initially opened so that the combustible mixture passes downwardly through the tubing string 24 into the bottom of the casing string 18 and then upwardly through the annulus 28. With the bleed off valve 60 opened, the fumes present in the casing string 18 are bled off at the surface permitting the combustible mixture to rise in the annulus 28. Eventually, the combustible mixture reaches the surface where its arrival can be verified by sampling the combustibility of vented products through the sampling nipple 62 and sampling valve 64. After it is verified that the combustible mixture has filled the casing string 18, the valves 60, 64 are closed. The delivery of the combustible gas and combustion supporting gas from the sources 48, 54 are continued until a desired pressure level is reached in the annulus 18 as may be verified by inspection of the gauge 58.

After the desired pressure level is reached, the valve 36 is closed thereby isolating the flow line 38 and gas sources 48, 54 from the well 10. The ignitor 66 is then energized through the electrical wires 68 to ignite the combustible mixture adjacent the valve 36. On ignition, the combustible mixture burns at a predictable rate so that the flame front reaches the bottom of the well 10 in a matter of seconds and then moves upwardly in the annulus and reaches the upper end of the well 10 in a few more seconds. During combustion, the temperature in the reaction zone is raised several hundred degrees. This, in turn, causes a substantial pressure increase of short but significant duration which is manifested throughout the interior of the casing 18 and tubing string 24 as may be detected by inspection of the gauge 58. During or immediately after combustion, hot combustion products, accompanied by unreacted nitrogen, enter the formation 16 through the perforations 22.

If the well 10 were subjected to only a single treatment as previously described and the well then placed back on the pump, some of the combustion products will necessarily return through the perforations 22 into the casing 18. These combustion products will transfer substantial heat to the formation 16 while a portion of these combustion products remain in the formation either in solution with the oil therein or intermingled therewith.

Rather than treating the well 10 with a single application of hot combustion products, multiple treatments of the well 10 are anticipated. The delay between the completion of one cycle of combustion and the redelivery of the combustible mixture into the tubing string 24 may vary considerably. If the temperature rise inside the casing 18 is low enough and/or the metallurgical properties of the casing string 18 and tubing string 24 are adequate to prevent damage thereto on an immediate subsequent combustion cycle, the cycle can be started as soon as the pressure inside the casing string 18 declines to a level where the next succeeding batch of combustible mixture can be delivered into the tubing string 24. If, on the other hand, the temperature rise inside the casing string 18 is sufficient to cause concern about metallurgical damage to the casing string 18 and/or tubing string 24, the commencement of the next combustion cycle can be deferred until the casing string 18 and tubing string 24 cool off sufficiently to prevent damage in the next combustion cycle. In this regard, it may be desirable to deliver relatively cool fuel gas from the source 48 into the tubing string 24 to cool off the casing and tubing string 18, 24 while bleeding off the coolant gas through the vent line 56.

It will be evident that multiple combustion cycles cause increasing amounts of combustion products to be driven further into the formation 16 where they remain for extended periods of time. As mentioned previously, there are three effects of the process of this invention. First, the delivery of hot combustion products at relatively rapid rates through the perforations 22 can increase permeability of the formation 16 adjacent the bore hole 12 by propagating existing fractures in the formation 16, by inducing new fractures in the formation 16 or by causing minor parting of the formation. Second, the oil in the formation 18 will be heated significantly thereby reducing its viscosity and improving its flow characteristics. As will be evident to those skilled in the art, reduction or viscosity of a heavy oil substantially improves productivity. Third, because it is a gas that is injected into the formation 16, some of the gas becomes dissolved in the hydrocarbon oil or intermingled therewith providing a drive mechanism tending to move oil from the formation 16 into the bottom of the casing string 18 where it can be pumped to the surface by a conventional pumping arrangement (not shown). One of the variables in the technique of this invention is the quantity of combustible mixture injected into the tubing string 24. Manifestly, the quantity should be sufficient so that, after combustion is complete, there are sufficient hot combustion products inside the casing string 18 which can flow through the perforations 22 into the formation 16. Accordingly, at a minimum, the tubing string 24 and/or casing string 18 need only be partially filled.

More desirably, however, sufficient combustible mixture is injected through the tubing string 24 to purge the annulus 28 to substantially fill the casing string 18 and tubing string 24 with the combustible mixture. In this circumstance, there is manifestly generated adequate hot combustion products to thermally stimulate the formation 16.

Preferably, the quantity of gas injected into the tubing string 24 is adequate not only to substantially fill the annulus 28 and tubing string 24 but also to inject a quantity of the combustible mixture into the formation 16 so that, upon combustion, some combustion occurs in the formation 16. It will be evident, of course, that there is no danger of inadvertently initiating in situ combustion in the formation 16 since the quantity of combustion supporting gas injected into the tubing string 24 is limited and inadequate to support extensive in situ combustion in the formation 16.

Superficially, this invention resembles the Talleyfrac technique wherein a liquid or slurry explosive is injected into the formation and then detonated. In fact, the techniques are vastly different as partially shown in following Table I:

TABLE I

Comparison of this invention and Talleyfrac

| Catagory | this invention | Talleyfrac |
|---|---|---|
| reaction type | combustion | explosion |
| reaction material | gaseous mixture | liquid or slurry |
| propogation of reaction | molecule to molecule as kindling temperature is reached | shock wave |
| where reaction occurs | in pipe string or in pipe string and formation | in formation only |
| pressure of reaction | variable, depending on initial pressure of mixture | fixed, depending on explosive composition, usually 30–40 atmospheres |
| rate of propogation | relatively slow, almost always less than 8000 ft/sec, typically on the order of hundreds of feet/sec | very rapid, above 15,000 ft/sec |
| time delay before pressure increase | on the order of a few milliseconds | on the order of a few microseconds |
| quantity of energy per unit volume | variable, depending on initial pressure of mixture | fixed, depending on explosive composition |
| effect on formation | fracture propogation, minor parting of formation | rubblizes formation, roughly 50% of energy compacts and damages formation |
| effect on formation fluids | heats fluids, lowers viscosity, provides drive mechanism, no significant contamination | no advantageous effects, only contaminates oil. |

Although the material in Table I is largely self explanatory, the remarks concerning contamination of formation fluids may require some explanation. In this invention, the products injected into the formation are largely in gaseous phase although vapor phase water injected into the formation will ultimately condense. It may be thought that the uncondensible products and/or unreacted nitrogen in the air, along with condensed water may be thought to be contaminants of the formation fluids. In fact, these materials are not considered to be seriously contaminating for a variety of reasons. First, uncondensed gases and/or water are commonly removed by ordinary surface equipment associated with producing oil wells. Accordingly, these materials are normally and readily separated from produced oil as a matter of normal operations.

On the other hand, the Talleyfrac process is subject to the criticism that a considerable quantity of the injected liquid or slurry explosive material does not detonate during the explosion and may ultimately be produced along with any recovered oil. Because the explosive material does not exhibit the specific gravity difference that gas or water does relative to produced oil, the unreacted explosive material is difficult to remove from produced oil with typical oil field equipment. There is accordingly some danger of the unreacted explosive material finding its way into a refinery vessel where the existence of elevated temperatures and pressures can cause inadvertent detonation. For this reason, most refineries will not knowingly accept oil produced from wells subjected to a Talleyfrac process.

With the tubing string 24 and casing string 18 filled with the combustible mixture, indications are that the pressure pulse generated inside the well 10 is on the order of about ten times the pressure therein prior to combustion. With relatively low initial pressures, the pressure pulse generated is insufficient to burst the casing string 18 at the surface. With a pressure rise of a factor of ten, it will be seen that it is relatively easy to burst the casing string 18 in the event the initial pressure is relatively high.

In order to prevent or minimize the possibility of damage to the casing string 18, an accumulator may be provided for the hot combustion gases generated during the process of this invention. Although the accumulator may be external to the well 10, it is convenient and desirable to use part of the annulus 28 for this purpose. To this end, after the combustible mixture has been placed in the well 10, a predetermined volume of accumulator gas may be injected into the annulus 28 through the vent line 56. Although the accumulator gas may be inert, i.e. neither combustible in air nor combustible in a fuel, this need not necessarily be the case since the amount of combustion occuring during any one pulse of the combustion of this invention is necessarily controlled by the quantity of combustible mixture injected at the surface.

The effect of the blanket of accumulator gas in the annulus 28 is best illustrated in FIG. 2. Referring to the solid line curve 66 in FIG. 2, the pressure response inside the well 10 is illustrated without the use of an accumulator. Pressure inside the well 10 increases along a segment 68 during filling of the well 10 with the combustible mixture. Ignition of the combustible mixture occurs at the point 70 whereupon a substantial pressure spike 72 occurs. Pressure inside the well 10 then bleeds off along the curved line 74 as the hot combustion products move through the perforations 22 into the formation 16.

The dashed line curve 76 illustrates the presssure response inside the well 10 using an accumulator. During filling of the well 10 with the combustible mixture, pressure rises in the well 10 along a segment 78 and ignition occurs at the point 80. A pressure plate 82 of substantially lower magnitude occurs because the accumulator blanket is compressed. Pressure inside the well 10 then declines along the curved segment 84 as the hot combustion products pass through the perforations 22 into the formation 16.

The pressure response inside the well 10 during the process of this invention is to be contrasted to the pressure response generated during the process disclosed in U. S. Pat. No. 2,858,891 which is shown as dotted line 86 in FIG. 2. Pressure inside the well 10 increases along a segment 88 until ignition occurs at the point 90 whereupon pressure increases along a segment 92 until it reaches a maximum and becomes substantially constant at a value 94 because of the continuous combustion occuring in the well.

Although the invention has been described in its preferred forms with a certain degree of particularity, it is understood that the present disclosure of the preferred form is only by way of example and that numerous changes in the details of operation and that various changes in the mode of operation may be resorted to without departing from the spirit and scope of the invention as hereinafter claimed.

I claim:

1. A method of treating a hydrocarbon producing well of the type having a casing string and a tubing string inside the casing string, both strings extending from the surface to adjacent a hydrocarbon bearing formation and being in fluid transmitting relation, comprising injecting into a first of the strings, at the surface, a combustible mixture including a gaseous phase material in a quantity larger than the volumetric capacity of the first string;

monitoring the other of the strings, at the surface, to detect the presence of the combustible mixture;

igniting the combustible mixture after detecting the presence of the combustible mixture at the surface;

valving the string closed and thereby preventing backflow of gaseous phase materials from the strings toward the surface during combustion of the mixture; and moving hot combustion products from the string into the formation.

2. The method of claim 1 wherein the quantity of combustible mixture is sufficient to fill the pipe string and part of the hydrocarbon bearing formation prior to ignition.

3. The method of claim 2 wherein the combustible mixture is present in the pipe string at the surface when ignition occurs and the igniting step comprises igniting the mixture at the surface.

4. The method of claim 1 wherein the combustible material comprises oxygen and a flammable material.

5. The method of claim 4 wherein the flammable material is substantially methane.

6. The method of claim 1 further comprising, after the termination of combustion of the combustible mixture, injecting into the one pipe string, at the surface, a second combustible mixture including a gaseous phase material in a quantity sufficient to substantially fill the pipe string from the surface to adjacent the formation; and igniting the second combustible mixture.

7. The method of claim 1 wherein the quantity of combustible mixture is sufficient to pass into the formation prior to ignition.

8. The method of claim 1 wherein the first string is the tubing string and the other string is the casing string.

9. A method of stimulating a hydrocarbon producing well of the type having a casing string extending from the surface to adjacent a hydrocarbon bearing formation and a tubing string, inside the casing string and communicating therewith, extending from the surface toward the hydrocarbon bearing formation, the method comprising steps for periodically injecting hot combustion products into the formation including (a) injecting into the tubing string, at the surface, a combustible mixture including a gaseous phase material in a quantity sufficient to substantially fill the tubing string and at least part of the annulus between the tubing and casing strings;

(b) injecting into the annulus at the surface, an accumulator gas in a quantity sufficient to fill only part of the annulus;

(c) preventing flow of the combustible mixture toward the surface;

(d) igniting the combustible mixture;

(e) combusting the mixture in the well and increasing the pressure in the well;

(f) moving hot combustion products from the well into the formation and thereby decreasing the pressure in the well; and then (g) repeating steps (a), (c), (d), (e) and (f).

10. A method for stimulating a hydrocarbon producing well of the type having a casing string extending from the surface to adjacent a hydrocarbon bearing formation and a tubing string, inside the casing string, extending from the surface toward the hydrocarbon formation, the method comprising steps for generating substantial pressure pulses in the strings and periodically injecting hot combustion products into the formation including (a) injecting into a first of the strings, at the surface, a combustible mixture including a gaseous phase material in a quantity sufficient to substantially fill the first string;

(b) valving the strings closed at the surface and thereby preventing flow of the combustible mixture and combustion products toward the surface;

(c) igniting the combustible mixture;

(d) combusting substantially all of the mixture in the well and generating a pressure pulse in the well;

(e) moving hot combustion products from the well into the formation and thereby decreasing the pressure in the well;

(f) valving open, at the surface, at least the first string to allow further injection of combustible mixture thereinto; and then (g) repeating steps (a), (b), (c), (d), (e) and (f).

11. The method of claim 10 wherein the tubing string and casing string communicate with each other and the injecting step includes injecting the combustible mixture into the tubing string in a quantity sufficient to at least partially fill the annulus between the tubing and casing strings.

12. The method of claim 11 wherein the magnitude of each of the pressure plates is on the order of about ten times the pressure in the well prior to the pulse.

* * * * *